US007407071B2

(12) United States Patent
Sperrfechter et al.

(10) Patent No.: US 7,407,071 B2
(45) Date of Patent: Aug. 5, 2008

(54) SETTING TOOL

(75) Inventors: Thomas Sperrfechter, Gruesch (CH); Wolfram Hahn, Friedrichshafen (DE)

(73) Assignee: Hilti Aktiengesellschaft, Schaan (LI)

( * ) Notice: Subject to any disclaimer, the term of this patent is extended or adjusted under 35 U.S.C. 154(b) by 32 days.

(21) Appl. No.: 11/510,483

(22) Filed: Aug. 23, 2006

(65) Prior Publication Data

US 2007/0045375 A1 Mar. 1, 2007

(30) Foreign Application Priority Data

Aug. 25, 2005 (DE) ..... 10 2005 000 106

(51) Int. Cl.
*B25C 1/14* (2006.01)

(52) U.S. Cl. ..... 227/10; 227/8; 227/130; 227/156

(58) Field of Classification Search ..... 227/8, 227/10, 156, 130; 267/136–139; 173/210, 173/211

See application file for complete search history.

(56) References Cited

U.S. PATENT DOCUMENTS

| | | | | |
|---|---|---|---|---|
| 3,465,942 | A * | 9/1969 | Diehl | 227/10 |
| 3,490,673 | A * | 1/1970 | Diehl | 227/10 |
| 4,824,003 | A * | 4/1989 | Almeras et al. | 227/10 |
| 5,056,701 | A * | 10/1991 | Bereiter | 227/10 |
| 5,797,534 | A * | 8/1998 | Almeras et al. | 227/10 |
| 6,085,958 | A * | 7/2000 | Kersten | 227/10 |
| 6,123,242 | A | 9/2000 | Kersten | |
| 6,220,495 | B1 * | 4/2001 | Jakob | 227/10 |
| 6,981,474 | B2 * | 1/2006 | Frommelt et al. | 123/46 R |
| 7,055,727 | B2 * | 6/2006 | Rohrmoser et al. | 227/10 |
| 2004/0104259 | A1 * | 6/2004 | Sprenger et al. | 227/10 |
| 2007/0057007 | A1 * | 3/2007 | Hahn et al. | 227/10 |
| 2007/0057008 | A1 * | 3/2007 | Franz | 227/10 |

FOREIGN PATENT DOCUMENTS

| | | | |
|---|---|---|---|
| DE | 3930592 | A1 | 9/1990 |
| DE | 19617671 | C1 | 10/1997 |

* cited by examiner

*Primary Examiner*—Rinaldi I. Rada
*Assistant Examiner*—Michelle Lopez
(74) *Attorney, Agent, or Firm*—Abelman, Frayne & Schwab

(57) ABSTRACT

A setting tool for driving fastening elements in a constructional component includes piston stop device for braking the setting piston, and is located at an end region of the hollow chamber of the piston guide in which the setting piston is displaceable, and has a damping element supported against a bottom, a stop element for the setting piston and adjoining the damping element in a direction of the hollow chamber, and an inertia body cooperating with the stop element and displaceable in a direction parallel to a longitudinal extent of the setting piston between first and second stops both of which are connected with the stop element and a distance between which, in a direction parallel to the longitudinal extent of the setting piston, is greater than a length of the inertia body in a same direction by length of a decoupling path.

7 Claims, 3 Drawing Sheets

SETTING TOOL

BACKGROUND OF THE INVENTION

1. Field of the Invention

The present invention relates to a setting tool for driving fastening elements in a constructional component and including a piston guide having a hollow chamber, a setting piston axially displaceable in the hollow chamber and having a piston head and a piston stem adjoining the piston head, a bolt guide adjoining the piston guide in a setting direction of the setting tool, and a piston stop device for braking the setting piston, located at an end region of the hollow chamber adjacent to the bolt guide, the piston stop device having a damping element supported against a bottom and a stop element for the setting piston and adjoining the damping element in a direction of the hollow chamber.

2. Description of the Prior Art

Setting tools of the type described above can be operated with solid, gaseous, or fluid fuels or with compressed air. With combustion-operated setting tool, the setting piston is driven by combustion gases. The setting tool can drive fastening elements such as, e.g., nails or bolts in a constructional component.

In setting tools such as disclosed in German Publication DE 39 30 592 A1, the setting piston is displaceably arranged in a piston guide axially displaceable in a housing sleeve of the setting tool. For initiating a setting process, the setting tool has to be pressed against a constructional component so that the piston guide is pushed into the housing sleeve. In order to reduce the piston energy at faulty settings or to reduce an excessive setting energy, there is provided, in the front portion of the piston guide, in the end region of the piston guide adjacent to the bolt guide, an elastic annular member for braking the setting piston.

The drawback of the known setting tool consists in that when the wear of the elastic annular member is too large and the wear is not recognized, essential and expensive tool components can be damaged. Further, the piston collar that impacts the annular member, should have as large a diameter as possible to prevent a premature damage of the annular member. This increases the weight of the setting tool. On the other hand, because of the elasticity of the annular member, the setting piston rebounds after impacting the annular member, and this leads, in particular at a high setting energy, to undesirable second blows with the setting piston.

German patent DE 196 17 671 C1, from which the present invention proceeds, discloses a powder charge-operated bolt setting tool with a setting piston displaceable in a guide bore. The setting piston has a piston head and a piston stem, with the piston head forming, at its side adjacent to the piston stem, a conical section. A conical receptacle, which is provided at the mouth-side end of the guide part, is arranged opposite the conical section formed by the piston head. At a faulty setting or an excessive setting energy, the conical section of the piston head passes into the conical receptacle. A damping disc, which is arranged behind the conical receptacle in the setting direction, dampens the impact of the piston.

In the setting tool of the above-mentioned German patent, an increased wear of the elastic damping disc, which takes place in the setting tool of DE 39 30 592 A1, is prevented. However, in the setting tool of the German patent, the other drawback of DE 39 30 592 A1, namely, rebound of the setting piston, leading to secondary blows, remains.

U.S. Pat. No. 4,824,003 discloses a setting tool in which between the piston guide and the bolt guide, there are provided a first rigid ring and an elastic ring arranged one after another. In the elastic ring, there is provided a further, more rigid ring that limits the stroke of the first rigid ring. The first rigid ring has a through-guide for the piston stem tapering in the setting direction. The piston collar surface adjacent to the first rigid ring is formed as a conical surface, with the profiles of the conical surface of the through-guide and the conical surface of the piston collar complementing each other.

The setting tool of the U.S. patent has the same drawback as the setting tool of the German patent. Here, likewise, possible rebounds of the setting piston can lead to the secondary blows.

Accordingly, an object of the present invention is to provide a setting tool of the type discussed above in which the foregoing drawbacks are eliminated, and the rebound speed of the setting piston is reduced to a minimum.

SUMMARY OF THE INVENTION

This and other objects of the present invention, which will become apparent hereinafter, are achieved by providing a setting tool including an inertia body cooperating with the stop element and displaceable in a direction parallel to a longitudinal extent of the setting piston between a first stop and a second stop both of which are connected with the stop element. A distance between the first stop and the second stop, in a direction parallel to the longitudinal extent of the setting piston, is greater than a length of the inertia body in a same direction by a length of a decoupling path.

Addition of the inertia body leads to a new mass distribution. As a result of mass distribution, at the first contact between the setting piston and the stop element, it is not the inertia force of the total mass of the stop element and the inertia body that acts as a counter-force on the setting piston for braking the setting piston. Rather, only a portion of the inertia force ascribed to the mass of the stop element acts on the setting piston. Thereby, the force peak, which appears on an impact, is reduced, and the setting piston is less loaded. Further, the multi-stage braking of the setting piston is achieved with a smaller resilient deflection, which positively influences the service life of the setting piston and the bolt guide. Still further, the stop element, upon rebound of the damping element, shortly after its change of direction, is displaced away from the inertia body in a direction opposite the setting direction, while the inertia body, because of its mass moment of inertia continues to displace in the setting direction within limits of the decoupling path. This displacement is stopped when the inertia body contacts the second stop. This leads to a low, non-critical rebound speed of the setting piston.

Advantageously, the inertia body is ring-shaped at least regionwise and is displaceable along a circumferential track provided on the stop element. Thereby, tilting and an outside function of the inertia body is prevented. Alternatively, the track can be provided on the piston guide.

Advantageously, the decoupling path has a length from about 0.2 mm to 3 mm, preferably, from 0.25 mm to 2 mm, which insures an optimal effect of the inertia body.

According to an advantageous embodiment of the present invention, the inertia body is formed as an elongate body projecting beyond the stop element in a direction opposite the bolt guide and has a collar embracing the stop element. This formation of the inertia body further increases its mass, which further reduces the rebound speed of the setting piston.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
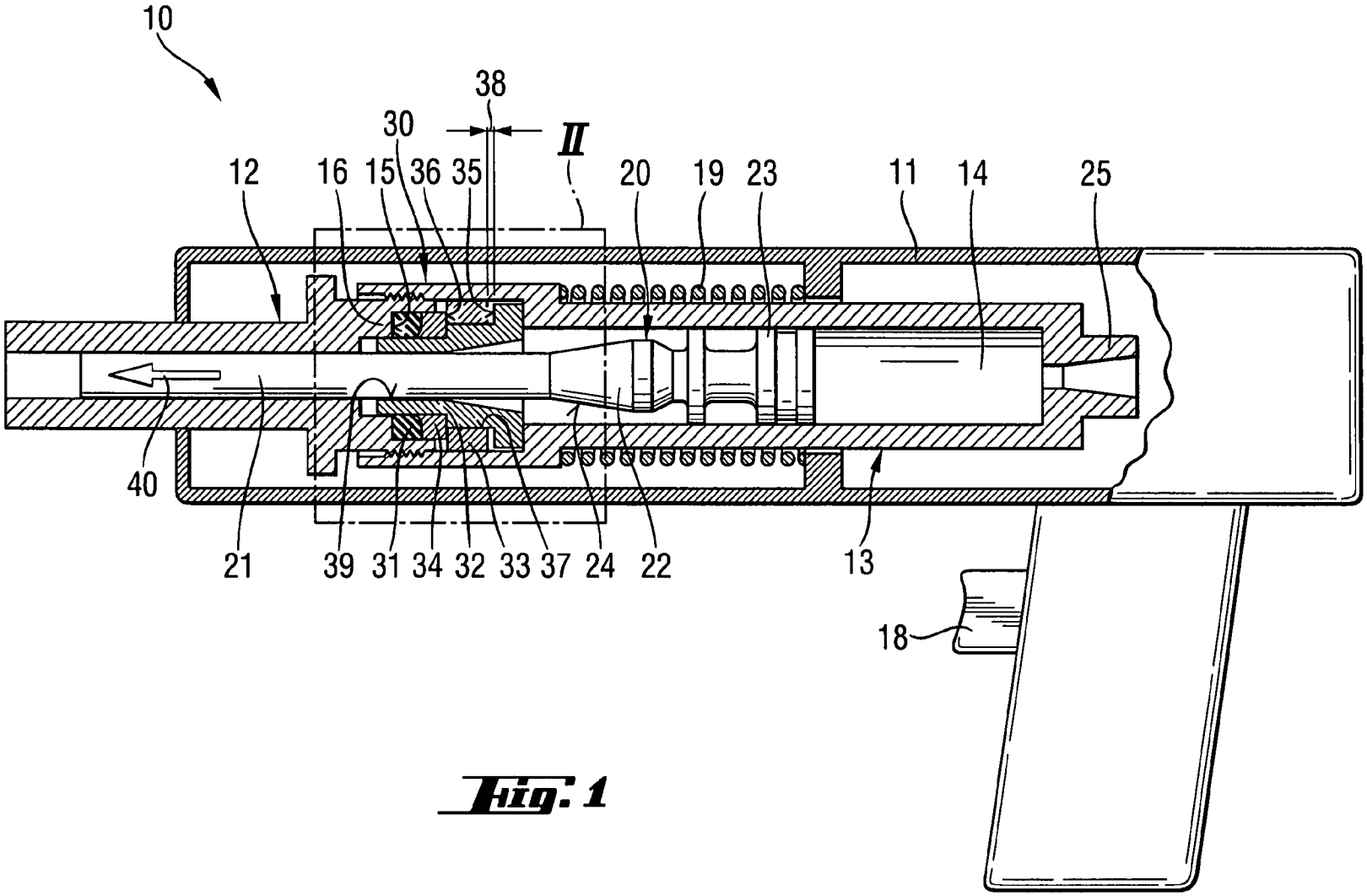
FIG. 1 a longitudinal, partially cross-sectional view of a setting tool according to the present invention with a piston stop device.
Figure 2:
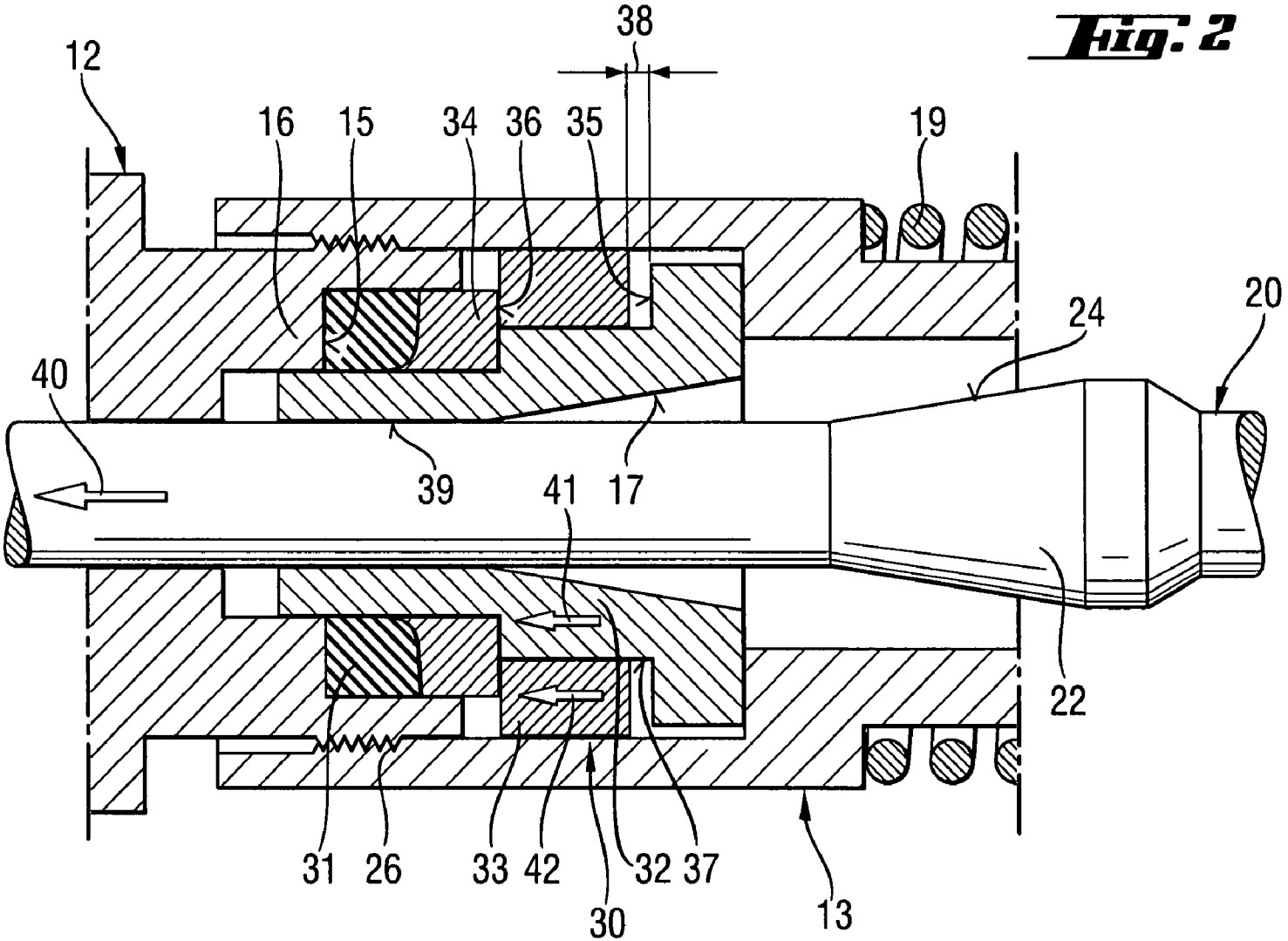
FIG. 2 a view of a detail of the setting tool shown in FIG. 1 marked with reference character II at an increased, in comparison with FIG. 1, scale.

A setting tool 10 according to the present invention, which is shown in FIGS. 1-2, has a piston stop device generally designated with a reference numeral 30. The setting tool 10 further includes a one- or multi-piece housing 11 and a piston guide 13 arranged in the housing 11. In the hollow chamber 14 of the piston guide 13, a setting piston 20 is displaceably arranged. The setting piston 20 is driven by a propellant or its reaction products, e.g., combustion gases or the like. The setting piston 20 has a piston stem 21 that adjoins, in a setting direction 40 of the setting tool 10, a piston head 23. On a piston stem 21, there is provided a piston collar 22 in a spaced relationship to the piston head 23. The piston collar 22 has a counter-stop surface 24 facing in a direction of the piston stop device. The counter-stop surface 24 is formed, in the embodiment shown in FIGS. 1-2, as a conical surface. The piston collar 22 can be arranged differently than shown in the drawings but always should be located in a region of the piston head 23 lying in the setting direction. The piston guide 13 is displaceably supported in the sleeve-shaped housing 11 and is supported against the housing 11 by a spring 19. At an end of the piston guide 13 facing in a direction opposite the setting direction 40, there is provided a cartridge socket 25 for receiving a propellant in the form of a cartridge, pellet or blister.

A setting process with the setting tool 10 is only then possible when the setting tool 10 is pressed with a bolt guide 12, which is located in front of the piston guide 13 in the setting direction 40, against a constructional component (not shown). An interface 26, at which the bolt guide 12 is connected with the piston guide 13, is formed, e.g., as a threaded section. For activating the setting tool 10 for initiating a setting process, there is provided on the setting tool 10, an actuation switch 18.

At the end of the piston guide 13 adjacent to the bolt guide 12, the above-mentioned piston stop device 30 is located. The piston stop device 30 is supported against bottom 15 of a receptacle 16 formed in the bolt guide 12. In the embodiment shown in the drawings, the piston stop device has a damping element 31, which is formed as an elastomeric ring, and stop element 32 which is formed as a metal sleeve member or a thrust member. The damping element 31 can be vulcanized or pinned on the stop element 32. In this way, the stop element 32 is damped indirectly and elastically by the damping element 31, and is supported, indirectly, against the bottom 15 that forms a stop. On the stop element 32, there is arranged an annular inertia body 33 displaceable along a track 37 provided on the stop element 32 between a first stop 35 and a second stop 36. The first stop 35 is formed by a projection of the stop element 32. The second stop 36 is formed on a retaining ring 34 fixedly connected with the stop element 32, e.g., by soldering. The axial length of the track 37 is greater than the axial width of the inertia body 33 by a decoupling path 38. The decoupling path 38 has a length of from about 0.2 mm to 3 mm, preferably, between 0.25 mm and 2 mm.

On the side of the stop element 32 remote from the bolt guide 12, there is provided a stop surface 17 which in the embodiment shown in the drawings, is formed as a conical surface against which the setting piston 20 can rebound with the counter-stop surface 24, which is formed on the piston collar 22, in order for the piston stop device 30 to brake the setting piston 20 when the setting piston 20 advances up to the stop element 32 as a result of a faulty setting or because of an excessive setting energy caused by the use of a too strong propellant. The counter-stop surface 24 is complementary to the stop surface 17 and is likewise formed as a conical surface. There is further formed, in the stop element 32, a cylindrical through-opening 39 through which the piston stem 32 extends.

When the setting piston 20, which is displaceable in the setting direction 40, strikes the stop element 32, the stop element 32 is pressed in the direction of arrow 41 against the elastic damping element 31 which, as result, jolts. As a result of mass distribution, at the first contact between the setting piston 20 and the stop element 32, it is not the inertia force of the total mass of the stop element 32 and the inertia body 33 that acts as a counter-force on the setting piston 20 for braking the setting piston 20. Rather, only a portion ascribed to the stop element 32. The inertia body 33, upon ignition, is displaced by inertia forces in an initial position shown in FIG. 2. Thereby, the force peak, which appears upon the impact, is reduced, and the piston 20 is less loaded.

Over the length of the decoupling path 38, the setting piston 20 is displaced in the direction of arrow 41 together with the stop element 32, without entraining the inertia body 33. After crossing the decoupling path 38, the first stop 35, which is formed by the displaceable stop element 32, abuts the inertia body 33. As a result, the mass of the inertia body 33 is added to the mass of the stop element 32, with the inertia member 33 movable in direction of arrow 42, and the setting piston 20 is subjected to a new braking effect. Also, the resilient deflection of the stop element 32 by the damping element 31, which is located in the receptacle 16 of the bolt guide 12, is reduced in comparison with a case when a stop element is used without an axially displaceable inertia body. The multi-stage braking of the setting piston 20 and a smaller resilient deflection positively influence the service life of the setting piston 20 and the bolt guide 12.

Upon the stop element 32 being displaced by a maximum resilient deflection path, the speed of the stop element 32 is reduced to zero within the system. At that time, decoupling between the stop element 32 and the inertia body 33 takes place. The stop element 32, upon rebound of the damping element 31, shortly after its change of direction, is displaced away from the inertia body 33 in a direction opposite the direction of arrow 41. The inertia body 33, because of its mass moment of inertia continues to displace in he direction of arrow 42 within limits of the decoupling path 38. This displacement is stopped when the inertia body 33 contacts the second stop 36. This leads to a low, non-critical rebound speed of the setting piston.

Alternatively to the above-described embodiment, the inertia body 33 can be formed, e.g., of two parts, e.g., in form of two ring halves. This is an advantage for assembly purposes because the retaining ring 34 can be eliminated, with the second stop 36 being also formed on the stop element 32. The two-part inertia body 33 can be placed, during assembly, between the two stops 35, 36 and, after mounting of the stop element 32 at the end of the piston guide 13, be held in its position on the track 37 of the stop element 32 by the piston guide 13.

Figure 3:
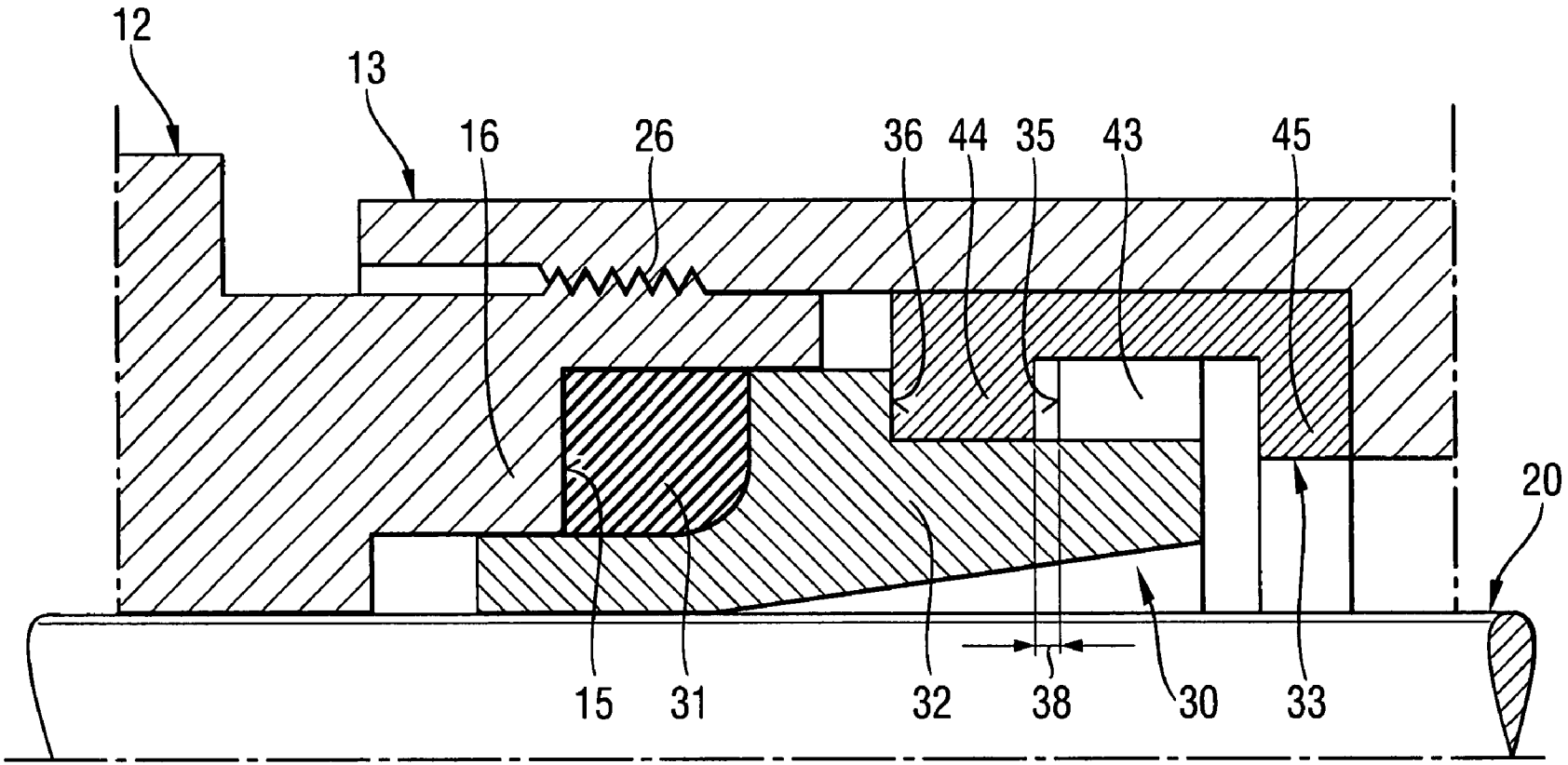
FIG. 3 a view similar to that of FIG. 2 of another embodiment of a setting tool according to the present invention.

The setting toot shown in FIG. 3 differs from the setting tool shown in FIGS. 1-2 in that in the embodiment shown in FIG. 3, the piston stop device 30 has an elongate, sleeve-shaped inertia body 33 which is connected with the stop element 32 by a bayonet connection. To form this connection, the stop element 32 has bayonet recesses 43 through which bayonet studs 44, which are provided on the inertia body 33, are extendable, with the inertia body 33 being secured on the stop element 32 by being rotated relative to the stop element 32. The inertia body 33 forms a collar 45 extending perpendicular to the piston stem 21 and embracing the end of the stop element 32 remote from the bolt guide 12. This construction of the inertia body 33 permits an increase of its mass, whereby the rebound speed of the setting piston can be further reduced. Further, a better guidance of the inertia body 33 is achieved because of a large guide surface in the piston guide.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A setting tool for driving fastening elements in a constructional component, comprising a piston guide (13) having a hollow chamber (14); a setting piston (20) axially displaceable in the hollow chamber (14) and having a piston head (23) and a piston stem (21) adjoining the piston head (23); a bolt guide (12) adjoining the piston guide (13) in a setting direction (40) of the setting tool (10); and a piston stop device (30) for braking the setting piston (20) and located at an end region of the hollow chamber (14) adjacent to the bolt guide (12), the piston stop device (30) having a damping element (31) supported against a bottom (15), a stop element (32) for the setting piston (20) and adjoining the damping element (31) in a direction of the hollow chamber (14), and an inertia body (33) cooperating with the stop element (32) and displaceable in a direction parallel to a longitudinal extent of the setting piston (20) between a first stop (35) and a second stop (36) both of which are connected with the stop element (32) and a distance between which, in a direction parallel to the longitudinal extent of the setting piston (20), is greater than a length of the inertia body (33) in a same direction by a length of a decoupling path (38).

2. A setting tool according to claim 1, wherein the inertia body (33) is ring-shaped at least regionwise and is displaceable along a circumferential track (37) provided on the stop element (32).

3. A setting tool according to claim 1, wherein the length of the decoupling path (38) amounts to from 0.2 mm to 3 mm.

4. A setting tool according to claim 1, wherein the inertia body (33) is formed as an elongate body projecting beyond the stop element (32) in a direction opposite the bolt guide (12) and has a collar (45) embracing the stop element (32).

5. A setting tool for driving fastening elements in a constructional component, the setting tool comprising:

a piston guide having a hollow chamber;

a setting piston axially displaceable in the hollow chamber and having:

a piston head; and a piston stem adjoining the piston head;

a bolt guide adjoining the piston guide in a setting direction of the setting tool; and a piston stop device for braking the setting piston and located at an end region of the hollow chamber adjacent to the bolt guide, the piston stop device having:

a damping element supported against a bottom;

a stop element for the setting piston and adjoining the damping element in a direction of the hollow chamber; and an inertia body including:

an elongate body projecting beyond the stop element in a direction opposite the bolt guide; and a collar embracing the stop element, with the inertia body cooperating with the stop element and displaceable in a direction parallel to a longitudinal extent of the setting piston between a first stop and a second stop, both of which are connected with the stop element and a distance between which, in a direction parallel to the longitudinal extent of the setting piston, is greater than a length of the inertia body in a same direction by a length of a decoupling path, wherein the length of the decoupling path is between about 0.2 mm and about 3.0 mm.

6. The setting tool according to claim 5, wherein the inertia body is ring-shaped at least regionwise and is displaceable along a circumferential track provided on the stop element.

7. The setting tool according to claim 5, wherein the length of the decoupling path amounts to from 0.2 mm to 3 mm.

* * * * *